United States Patent [19]

Harrison et al.

[11] 4,128,472

[45] Dec. 5, 1978

[54] SOLVENT DEWAXING PROCESS

[75] Inventors: Charles W. Harrison, Nederland, Tex.; Paul P. Bozeman, Jr., deceased, late of Groves, Tex., by Arlene Bozeman, executrix

[73] Assignee: Texaco Inc., New York, N.Y.

[21] Appl. No.: 813,141

[22] Filed: Jul. 5, 1977

[51] Int. Cl.[2] ..... C10G 43/08

[52] U.S. Cl. ..... 208/33; 208/37

[58] Field of Search ..... 208/33

[56] References Cited

U.S. PATENT DOCUMENTS

| | | | |
|---|---|---|---|
| 3,350,297 | 10/1967 | Torobin | 208/33 |
| 3,720,599 | 3/1973 | Gould | 208/33 |
| 3,764,517 | 10/1973 | Bodemuller | 208/33 |
| 4,013,542 | 3/1977 | Gudelis et al. | 208/33 |

OTHER PUBLICATIONS

Chen et al., "Chemical Engineering," Mar. 19, 1973, pp. 105 to 111.

*Primary Examiner*—Herbert Levine

*Attorney, Agent, or Firm*—Carl G. Ries; T. H. Whaley; Douglas H. May, Jr.

[57] ABSTRACT

A solvent dewaxing process for removing wax from intermediate grade waxy petroleum distillate oils wherein a waxy oil stock, prediluted with 0-2 volumes dewaxing solvent is heated to a temperature in the range of about 110 to 130° F for melting all wax therein; wherein the heated waxy oil stock/solvent mixture is cooled to about 5° F above the depressed cloud point and is diluted with 1-5 volumes dewaxing solvent having a temperature 25°-40° F below the depressed cloud point for forming a wax/oil/solvent mixture having a temperature 5°-15° F below the depressed cloud point, and wherein the wax/oil/solvent mixture is further cooled at 1°-8° F/min. to a selected separation temperature in the range of 0 to −40° F for precipitating additional wax. Precipitated wax is removed at the separation temperature to produce a wax free oil/solvent mixture which is subsequently fractionated to yield a dewaxed oil suitable for use in lubricating oils.

8 Claims, 1 Drawing Figure

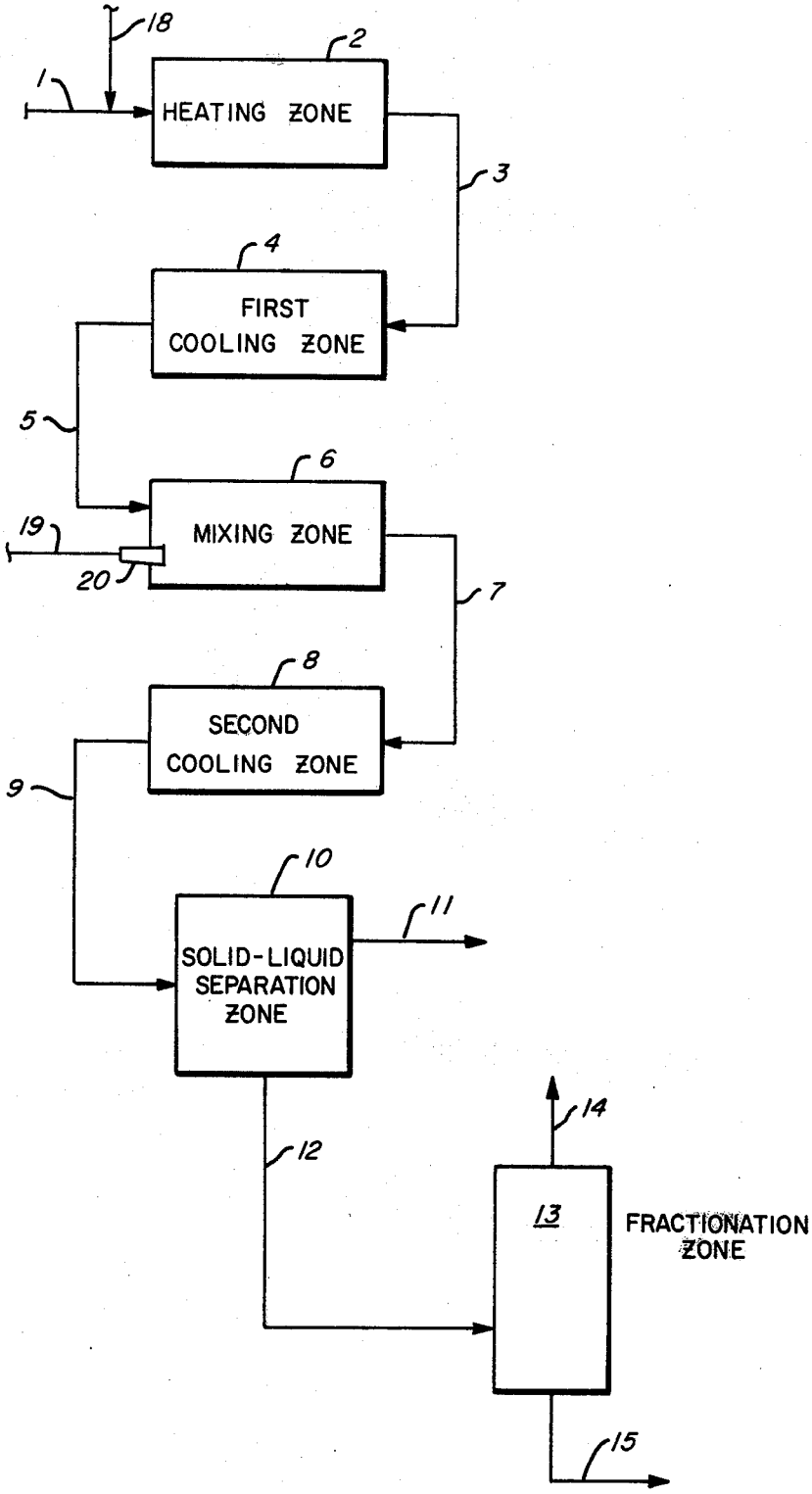
18
2
1
HEATING ZONE
3
4
FIRST COOLING ZONE
5
6
19
MIXING ZONE
20
7
8
SECOND COOLING ZONE
9
10
11
SOLID-LIQUID SEPARATION ZONE
14
12
13
FRACTIONATION ZONE
15

SOLVENT DEWAXING PROCESS

BACKGROUND OF THE INVENTION

The present invention relates to a solvent dewaxing process for dewaxing an intermediate waxy distillate petroleum oil stock. More particularly, the invention relates to a solvent dewaxing process, wherein a mixture of waxy oil stock and a first portion of solvent, cooled to a temperature about 5° F. (3° C.) above the depressed cloud point, is contacted with a second portion of solvent under conditions wherein wax crystal nuclei precipitate, and wherein the resulting mixture is cooled by direct or indirect heat exchange for precipitating additional wax.

DESCRIPTION OF THE PRIOR ART

It is known in the prior art to dewax waxy petroleum oil stocks by cooling oil-solvent solutions at uniformly slow rates, of e.g. 1°-8° F./minute (0.56° to 4.4° C./min) under controlled conditions for crystalization of wax from said solutions. Commercially, such oil-solvent solutions are cooled according to several methods such as indirect cooling in scraped surface exchangers; dilution chilling wherein waxy oil stock is contacted in a multi-stage tower with chilled solvent under conditions of high levels of agitation (U.S. Pat. No. 3,773,650); and direct chilling, wherein a low boiling solvent, e.g. propylene, mixed with waxy oil stock is vaporized under conditions of reduced pressure.

In such commercial processes, the waxy oil charge, or solutions of waxy oil and solvent, are heated to a temperature at which all the wax present is dissolved. The heat charge is then passed into a cooling zone wherein cooling is unertaken at a uniform slow rate in the range of about 1°-8° F./minute (0.56°-4.4° C./min) until a temperature is reached at which a substantial portion of the wax is crystalized, and at which dewaxed oil product has a selected pour point temperature. Upon achieving the desired dewaxing temperature, the mixture of wax crystals, oil and solvent is subjected to solid-liquid separation for recovery of a wax free oil-solvent solution and a solid wax containing a minor proportion of oil (slack-wax). The separated oil-solvent solution is subjected to fractional distillation for recovery of solvent, which is recycled, and product dewaxed oil. The slack wax may be recovered as is, or may be subjected to additional processing, such as repulp filtration, for removal of oil therefrom.

Solid-liquid separation techniques which may be employed for separation of wax crystals from the oil-solvent solutions include known solid-liquid separation process such as gravity settling, centrifugation, and filtration. Most commonly, in commercial processes, filtration in a rotary vacuum filter followed by solvent wash of the wax cake is employed.

Dewaxing solvents which may be used in such processes include known dewaxing solvents. Commonly used solvents include aliphatic ketone of 3-6 carbon atoms, $C_2$-$C_4$ range hydrocarbons, $C_6$-$C_7$ aromatic hydrocarbons, halogenated $C_1$-$C_4$ hydrocarbons and mixtures of such solvents. Solvent dilution of waxy oil stocks maintains fluidity of the oil for facilitating easy handling, obtaining optimum wax-oil separation, and obtaining optimum dewaxed oil yields. The extent of solvent dilution depends upon the particular oil stocks and solvents used, the approach to filtration temperature in the cooling zone, and the desired final ratio of solvent to oil in the separation zone.

For processes employing indirect cooling in scraped surface exchangers, cooling and wax crystalization is accomplished under conditions of very little agitation at a rate in the range of about 1°-8° F./minute (0.56° to 4.4° C./min). Under such conditions, without wall scrapers, wax tends to accumulate on the cold exchanger walls, interferring with heat transfer, and causing increased pressure drop. Thus, scrapers are employed to remove the accumulate wax. Dewaxing solvents are employed to maintain fluidity of the oil in the coolers and chillers, and may be added before the oil is cooled or in increments during cooling. Often the oil is given a final dilution with solvent at the separation temperature for reducing solution viscosity such that wax separation is more efficient. Commonly, solvent added to the oil in such processes is at the same temperature, or somewhat higher temperature, than the oil. Cold solvent, added at substantially lower temperatures than the oil, shock chills the oil, resulting in formation of many small wax crystals which are difficult to separate. Under controlled conditions, elongated wax crystals of good size are formed which are easy to separate and which contain little occluded oil.

Dilution chilling processes employ incremental addition of cold solvent, e.g. +20° to −25° F. (−6.7° to −32° C.) to the oil under conditions of agitation such that oil and solvent are completely mixed in less than one second. Under such conditions, wax precipitates in small, hard balls rather than elongated crystals. Such wax precipitates are easy to separate and retain very little oil.

Direct chilling processes employ a low boiling hydrocarbon, eg. propylene, as dewaxing solvent and refrigerant. Waxy oil stock is diluted with sufficient lowboiling hydrocarbon to provide the necessary cooling and provide the desired final dilution for separation of solid wax from the oil-solvent solution. The light hydrocarbon is vaporized from the oil-light hydrocarbon solution under conditions of reduced pressure, at a rate sufficient to cool the solution about 1°-8° F. per min (0.56° to 4.4° C./min). Such cooling is continued until the desired separation temperature and wax crystalization are obtained. At the separation temperature, sufficient low-boiling hydrocarbon remains in solution with the oil to provide the desired fluidity for good separation of wax. Agitation of the mixture being cooled is commonly provided for reduction of temperature and concentration gradients.

In these processes of the prior art, rotating mechanical equipment, either scrapers or high speed agitators, are employed to facilitate good heat transfer from the oil. Such mechanical equipment is expensive, difficult to maintain, and can contribute to breaking and deformation of wax crystals.

SUMMARY OF THE INVENTION

Now, according to the present invention we have discovered an improved continuous solvent dewaxing process for separating solid wax from intermediate waxy distillate petroleum oil stocks.

A preferred embodiment of the process of the present invention comprises prediluting said waxy oil stock with a first portion of dewaxing solvent in a volume ratio of solvent to oil stock in the range of about 0:1 to 2:1 respectively; heating in a heating zone the resulting first mixture to a temperature in the range of about 110° to 130° F. (43° to 54° C.) for melting all solid wax present and forming an oil-solvent solution; cooling, in a first cooling zone, the oil-solvent solution at a uniform rate of about 1°–8° F./min (0.56°–4.4° C./min) to a temperature about 5° F. (3° C.) above the depressed cloud point; mixing, in a mixing zone, the cooled oil-solvent solution with a second portion of dewaxing solvent in an amount equivalent to about 1–5 volumes waxy oil charge, having a temperature about 25° to 40° F. (14° to 22° C.) below the depressed cloud point, under conditions of plug flow radial mixing, for forming a second mixture comprising oil-solvent solution and wax nuclei at a temperature about 5° to 15° F. (3° to 8° C.) below the depressed cloud point; cooling said second mixture, in a second cooling zone, at a uniform rate of about 1°–8° F./min (0.56° to 4.4° C./min) to a selected separation temperature for crystalizing additional wax from said second mixture, separating, in a solid-liquid separation zone; said second mixture at said separation temperature into a solid slack wax component and a liquid oil-solvent component, and fractionating, in a fractionation zone, the separated oil-solvent component into a dewaxed oil fraction and a solvent fraction.

In a second embodiment of the present invention,

According to the present invention, predilution solvent is employed with heavier waxy oil stocks within the range of intermediate waxy oil stocks. Contemplated herein, whereas, for lighter waxy oil stocks, predilution solvent may be dispensed with.

Advantages of the present invention over processes of the prior art include elimination of rotating mechanical equipment such as wall scrapers and/or agitators from the dewaxing process. Elimination of rotating mechanical equipment reduces cost of constructing solvent dewaxing facilities, and reduces manpower, expense and down time required for operating and maintaining such rotating mechanical equipment.

Plug flow radial mixing of oil solvent mixtures, in at least the first cooling zone, and preferably in the second cooling also, results in improved heat transfer from the oil-solvent mixture and reduces operating costs by improving efficiency. However, the greatest advantage is that transverse temperature differentials across the cross-sectional area of flowing oil-solvent mixture, heat exchange surface to the center of the oil-solvent mixture is reduced to about 1° F. (0.56° C.) or less, such that substantial subcooling of portions of the mixture close to the walls is avoided, thus reducing deposition of wax upon said cold walls. These advantages, and others will be explained more fully in the detailed description which follows.

BRIEF DESCRIPTION OF THE DRAWING

The drawing is a schematic representation of a solvent dewaxing process employing improvements of the present invention.

DESCRIPTION OF TERMS

Intermediate waxy petroleum distillate oil stocks are contemplated as charge stocks to the solvent dewaxing process of the present invention. Such intermediate waxy petroleum distillate oil stocks have a viscosity in the range of about 200–350 SUS at 100° F., (38° C.) and boil in the range of about 625° F. (330° C.) initial boiling point to about 1100° F. (593° C.) end point. Such intermediate waxy petroleum distillate oil stocks may be derived from raw lube oil stocks, the major portion of which boil above 650° F. Such raw lube oil stocks can be vacuum distilled with overhead and side draw distillate streams and a bottom stream referred to as residual oil stock. Considerable overlap in boiling ranges of distillate streams and the residual stream may exist, depending upon distillation efficiency. Some heavier distillates have almost the same distribution of molecular species as the residual stream. Preferably, paraffinic crude oils are used as sources of lube oil stocks.

Such distillate streams contain aromatic and polar compounds which are undesirable in lubricating oils. Such compounds may be removed, by means such as solvent extraction, hydrogenation, and other means well known in the art, either before or after solvent dewaxing. Treatment of distillate streams before solvent dewaxing reduces the volume of oil to be dewaxed, which concomitantly reduces the amount of solvent employed, heat load, etc.

Wax content of a waxy distillate oil stock is defined by the amount of material to be removed to produce a dewaxed oil with a selected pour point temperature in the range of +25° to −40° F. (−3.9° to −40° C.). Wax content of waxy distillate oil stocks will vary in the range of 5 to 35 wt. percent. The wax material removed in solvent dewaxing is a complex mixture of straight chain and branched chain paraffins and naphthenic hydrocarbons. Wax in light distillate oil stocks generally predominantly comprises normal parrafin hydrocarbons which have relatively high crystal growth rates. Wax in heavier distillate oil stocks comprise mixtures of normal and isoparaffin hydrocarbons having relatively slower crystal growth rates. In solvent dewaxing processes, wax is separated as solid crystals.

Dewaxed oil, as the term is used herein, is the product from the dewaxing process after solid wax and solvent have been removed. Commonly the dewaxed oil derived from distillate oil stocks contemplated as charge stocks herein will have pour points in the range of about +25° to −40° F. (−3.9° to −40° C.).

Pour Point is the temperature at which an oil will cease to flow when chilled under prescribed conditions (ASTM-D-97-66). The pour point temperature of an oil stock is reduced in a solvent dewaxing process by removing wax therefrom. The pour point temperature of dewaxed oil determines the useful temperature range of lubricating oil manufactured therefrom, and is indicative of other properties such as viscosity, etc.

The Cloud Point is the temperature at which a cloud or haze of wax crystals first appears when a wax containing oil is cooled under prescribed conditions (ASTM-D-2500-66). The cloud point of a waxy oil stock may be depressed by addition of solvent in which oil and wax are soluble. The amount of cloud point depression is dependent upon degree of dilution with solvent, nature of feedstock, type or mixture or solvents employed, etc.

Dewaxing solvents contemplated for use in the present invention, include known dewaxing solvents. For example, dewaxing solvents may be selected from: aliphatic ketones of 3 to 6 carbon atoms; lower molecular weight hydrocarbons e.g. ethane, propane, butanes, and particularly propylene; Aromatic hydrocarbons such as benzene and toluene; halogenated low molecular weight hydrocarbons of 1 to 4 carbon atoms, e.g. dichloroethane, methylenechloride, etc; and mixtures of the above. Useful dewaxing solvent mixtures are mixtures of methyl ethyl ketone and methyl isobutyl ketone; mixtures of ketones with propylene; mixtures of ketones with $C_6$-$C_7$ aromatic hydrocarbons and mixtures of dichloroethylene and methylenechloride. Particularly useful in the process of the present invention are mixtures comprising 30–70 volume percent methyl ethyl ketone and 70–30 volume percent toluene.

Solvent dilution in solvent dewaxing processes contemplated herein refers to diluting waxy oil charge stock with solvent in volume ratios in the range of about 1:1 to 5:1 solvent to oil, for improving wax removal from the oil, maintaining fluidity of the oil under cooling, or chilling, conditions in the process, obtaining optimum wax separation rates, and obtaining optimum dewaxed oil yields. The extent of solvent dilution is dependent upon the particular waxy oil stock, the solvent system employed, the extent of cooling in the cooling zone, and the desired final viscosity of the wax/oil/-solvent mixture going to the wax separation zone. In the prior art it is known that solvent may be added to waxy oil stock before cooling commences (referred to as predilution), in increments as the oil stock is cooled, at the exit from the cooling zone, or by a combination of the above methods. One solvent may be added at one point in the solvent dewaxing process and another at another point, or the same solvent may be employed throughout. Generally, it has been observed that addition of a cold solvent (e.g. in range of −25° to +20° F. (−32° to −7° C.) to a warmer waxy oil stock, must be accompanied by vigorous agitation for formation of large, easily separated wax crytals. Without vigorous agitation, cold solvent injected into waxy oil stock tends to form extremely small wax crytals which are difficult to separate.

Plug Flow Radial Mixing within contemplation of in the present invention, refers to mixing the solvent-oil mixture in an elongated tubular mixing zone by splitting the flowing fluid into two or more strata each of which is then helically rotated in one direction about its hydraulic center, resulting in radially mixing the flowing fluid such that fluid is forced from the center outward to the outer wall of the tube, and vice versa, then splitting these strata into two or more additional strata, each of which is then helically rotated in the opposite direction about its hydraulic center, etc. The overall effect of such mixing is to cause the flowing stream to be continuously divided and redivided into strata which are continuously radially inverted, such that elements of the fluid entering at the center of the flowing stream are forced to the outer wall, and vice versa, on a continuous basis. Such radial mixing is accomplished with very little backmixing such that the flow of fluid approximates plug flow. Flow of fluid may be in the laminer range or in the turbulent range. In such plug flow radial mixing, transverse gradients in temperature, velocity and composition are substantially reduced or eliminated. Additionally, heat transfer from the body of flowing fluid to the wall of the mixer is substantially increased. Mechanical devices to accomplish such plug flow radial mxing may be obtained from Kenics Corporation, and are described in "MOTIONLESS MIXERS FOR VISCOUS POLYMERS", Chen and MacDonald, *Chemical Engineering,* March 19, 1973, p. 105ff. In the present invention, plug flow radial mixing makes three important contributions to the process: Transverse temperature differences across the flowing fluid are reduced to 1° F. (0.56° C.) or less in the cooling zone, such that super cooled oil-solvent mixtures do not reside at the cold wall depositing wax thereon; the flow of oil-solvent mixture is directed at the cold wall, scouring away any wax which may accumulate; and in the mixing zone, solvent and oil are rapidly blended into a mixture having a uniform temperature throughout.

Cooling rate in solvent dewaxing processes generally and the process of the present invention particularly, has been observed to be determinate of the size of wax crystals formed in the wax/oil/solvent mixture. Lower cooling rates yield larger, easy to separate crystals, with less oil occluded therein. Conventionally, oil-solvent mixtures are cooled at uniform slow rates in the range of 1–8° F. per minute. Preferably cooling rates are in the range of 1.5° to 3° F./min (0.8° to 3° C./min). Although larger wax crystals containing less occluded oil are formed at lower cooling rates, economy demands that the rate be at least about 1° F. per minute. At cooling rates above about 8° F. per minute, the wax crystals formed are small, difficult to separate and contain much occluded oil. Nucleation of new wax crystals and growth of existing wax crystals from an oil-solvent mixture are both proportional to the degree of supersaturation of wax in the oil-solvent mixture. As the oil-solvent mixture is cooled, wax precipitation, as new nuclei or as growth of existing crystals, lags as a result of mass transfer, such that the mixture is somewhat supersaturated. Nucleation of new wax crystals is favored over crystal growth at higher degrees of supersaturation which result at higher cooling rates. Thus, the lowest economical cooling rate is to be preferred. When waxy oil stocks, or oil-solvent mixtures are cooled to the cloud point a large numer of small wax crystal nuclei precipitate forming a haze or cloud in the liquid. Under conditions of uniform slow cooling, in the 1°–8° F. per minute range, these small crystals tend to grow into larger, easily separable crystals, at the expense of formation of additional small wax crystals nuclei as the temperature is reduced.

DESCRIPTION OF THE DRAWING

For better understanding the process of the present invention, reference is now made to the drawing. The drawing is a schematic representation of a solvent dewaxing process employing improvements of the present invention, and only those elements of the process necessary for an understanding of the present invention are included. Mechanical features and process equipment unnecessary for an understanding of the present invention have been omitted for the sake of clarity. The drawing, and the description which follows are intended to demonstrate an embodiment of the present invention, and are not to be construed as limitations of the invention which is set-out in the claims appended to this application.

In the drawing, waxy petroleum distillate oil stock (waxy oil stock) having physical properties within ranges heretofore set-out in the specification, flow via line 1, into heating zone 2. A first portion of dewaxing solvent from line 18, in an amount equivalent to about 0 to 2 volumes waxy oil charge flows into line 1 as required for decreasing the viscosity and depressing the cloud point of the resulting mixture. In heating zone 2, the waxy oil stock and solvent are heated by indirect heat exchange to a temperature in the range of about 120° to 160° F. (49° to 71° C.) at which all solid wax present is melted and a completely liquid first oil-solvent solution results. In embodiments of this invention, wherein relativey light waxy oil stocks are charged, predilution with dewaxing solvent may be omitted and the undiluted waxy oil stock is heated, in the heating zone, for melting all the solid wax present. Dewaxing solvent is selected from known dewaxing solvents, as heretofore set-out in this specification. Particularly useful dewaxy solvents are mixtures comprising about 30–70 vol. percent methyl ethyl ketone, and about 70–30 vol. percent toluene, although other dewaxing solvents such as propylene, mixtures of methyl ethyl ketone and methyl isobutyl ketone, and mixtures of ethylene dichloride and methyl chloride may be used to advantage. The amount of solvent may be in the range of 0-2 volumes of waxy oil stock for maintaining fluidity of the waxy oil stock/solvent mixture exiting first cooling zone 4, as will be described below.

In the drawing, heated first oil-solvent solution (or undiluted waxy oil stock) having all wax dissolved therein, flows from heating zone 2, via line 3, into first cooling zone 4. In first cooling zone 4 the first oil-solvent solution is cooled to a temperature about 5° F. (3° C.) above the depressed cloud point. The temprature of the depressed cloud point will vary, depending upon the particular waxy oil charge, type of solvent and solvent to oil ratio employed. Cooling may be accomplished in first cooling zone 4 by direct heat exchange, such as vaporization of a low boiling solvent at reduced pressure, or preferably by indirect heat exchange with a refrigerant fluid. Rate of cooling in first cooling zone 4 is not critical as the outlet temperatue is above the depressed cloud point at which wax will precipitate. It is desirable to avoid cold spots in the oil-solvent solution, such as at the cold walls of an indirect heat exchanger in cooling zone 4, where wax may precipitate and accumulate. Preferably, the oil-solvent solution in cooling zone 4 is mixed sufficiently well to avoid temperatures below the depressed cloud. Particularly, it is preferred that first cooling zone 4 be a tubular double pipe heat exchanger and that the oil-solvent solution be subjected to plug flow radial mixing to maintain transverse temperature gradients of about 1° F. or less.

In the drawing, first oil-solvent solution, in the liquid about 5° F., above the depressed cloud point flows via line 5 into the inlet of mixing zone 6.

A second portion of dewaxing solvent, from line 19, at a temperature in the range of about 25° to 40° F. (14° to 22° C.) below the depressed cloud point of te resulting oil/solvent mixture and in an amount equivalent to about 1–5 volumes of waxy oil charge, flows into the inlet of mixing zone 6, for directly cooling first oil-solvent solution to a temperature in the range of 5° to 15° F. (3° to 8° C.) below the depressed cloud point of the resulting mixture. Preferably the second portion of solvent from line 19 is injected into the oil-solvent stream flowing into mixing zone 6 from line 5 as a spray of fine droplets from nozzle 20. Many nozzles designed for dispersing liquids as a spray of fine droplets are commercially available and are suited for use in this service.

The temperature of solvent entering mixing zone 6, will generally be within the range of about 70–100° F. (20° to 38° C.), and is selected such that the resulting second oil-solvent mixture leaving mixing zone 6 will be at a temperature in the range of 5° to 15° F. (3° to 8° C.) below the depressed cloud point of the resulting mixture. Preferably, in the range of about 5–10° F. (3–6° C.) below the depressed cloud point. Depressed cloud point temperatures for solvent waxy oil stock solutions within contemplation of the present invention will be in the range of about 85° to 120° F. (30° to 49° C.). Direct cooling of waxy oil stock with solvent by mixing according to the process disclosed herein results in forming wax crystals having very little oil occluded therein and which are easily separated from the oil-solvent mixtures.

Accordingly, the second portion of dewaxing solvent equivalent to about 1 to 5 volumes of the waxy oil stock charge is injected in the form of fine droplets via nozzle 20 into plug flow radial mixing zone 6 through which the first oil-solvent solution is flowing. This second portion of dewaxing solvent is thoroughly mixed with the dewaxing solvent and the resulting oil-solvent mixture has a temperature about 5° to 15° F. (3° to 8° C.) below the depressed cloud point of the second oil-solvent mixture. Wax crystal nuclei precipitate under these conditions, and the oil forms a solution with the solvent. Plug flow radial mixing distributes the wax crystals homogeneously throughout the flowing stream.

In the drawing, the second wax nuclei/oil/solvent mixture from mixing zone 6 flows via line 7 into cooling zone 8 for precipitation of additional wax. In cooling zone 8, the mixture is cooled at a uniform rate in the range of 1–8° per minute (0.56° to 4.4° C./min), preferably 1.5°–5° F. per minute (0.8° to 3° C./min), to a selected separation temperature in the range of +25° to −40° F. (14° to −40° C.). During this cooling step, additional wax crystallizes from the oil-solvent solution, thus decreasing the pour point of oil remaining in solution with the solvent. A major portion of wax crystallized in cooling zone 8 accumulates on wax nuclei already present, causing them to grow into easily separable wax crystals. Cooling in cooling zone 8 is continued until sufficient wax is precipitated such that the dewaxed oil product has a desired pour point in the range of 0° to −25° F. (° C.). Cooling the second wax/oil/solvent mixture in cooling zone 8 is preferably via indirect heat exchange with a refrigerant fluid, however direct heat exchange by vaporizing a portion of dewaxing solvent such as propylene at reduced pressure may also be employed.

In the drawing, second wax/oil/solvent mixture, at the selected separation temperature obtained in cooling zone 8, flows via line 9 to solid-liquid separation zone 10 wherein wax crystals are separated from oil-solvent solution. Solid-liquid separation may be accomplished by solid-liquid separation methods known in the art, such as gravity settling, centrifugal separation, filtration, etc. Preferably, and commonly practiced in commercial processes, solid wax is separated from oil-solvent solutions by vacuum filtration. That is, the second wax/oil/solvent mixture at the separation temperature flows into a holding tank of a rotary vacuum filter having a rotating filter drum covered with a filter cloth. Oil-solvent solution is pulled through the filter cloth by an imposed vacuum, and wax accumulates upon the cloth as a filter cake. As the drum rotates out of the holding tank, additional oil-solvent solution entrained in the filter cake is pulled through the cloth, and commonly, wash solvent is sprayed upon the filter cake to displace additional oil. Wash solvent, which may be the same or different from the dewaxing solvent, is likewise pulled through the filter cloth by vacuum action, carrying dissolved oil with it. After the solvent wash, air may be drawn through the wax filter cake for evaporating residual wash solvent, thereby drying the wax cake. At the end of the filter cycle, the wax cake is removed from the filter cloth by a blast of pressurized air, or a scraper such as a doctor knife, and the rotating drum carries the filter cloth into the holding tank for contact with additional wax-oil-solvent mixture.

In the drawing, wax from solid-liquid separation zone 10, known as slack wax and containing some oil entrained therein, is recovered via conduit 11 for further refining or for recovery as is. Separated oil-solvent solution, from solid-liquid separation zone 10, flows via line 12 to fractionation zone 13. In fractionation zone 13, the oil-solvent solution is separated into a solvent fraction which is recovered via overhead line 14, and a dewaxed oil fraction which is recovered as product via line 15.

In the process of the present invention, it is contemplated that waxy oil charge stock will be suitable for manufacture of lubricating oils. Thus, a particular waxy oil charge stock will have a boiling range, viscosity, and composition suitable for manufacturing a particular quality lubricating oil. Solvent dewaxing is performed for removing wax from the waxy charge stock, thereby lowering the pour point temperature to a value suitable for the particular lubricating oil being manufactured. Other refining processes, outside the scope of the present invention, such as solvent extraction, hydrogenation, etc. are commonly performed on the waxy oil charge stock and/or the dewaxed oil for adjusting other properties of the oil, such as viscosity index, to values suitable for the particular lubricating oil.

Production of lubricating oils is relatively low volume operation, compared to other petroleum refining operations. Consequently in commercial solvent dewaxing operations it is common practice to process one waxy oil stock at one time and other waxy oil stocks at other times, in blocked out operation. Consequently, flexibility of processing equipment for handling a wide range of operating conditions is very desirable. The process disclosed herein is readily adopted to such requirements.

Heating waxy oil stock and solvent in heating zone 2 is preferably by indirect heat exchange from a heating medium such as steam, hot gas, or other heat transfer fluid to the waxy oil stock. Heating zone 2 may conveniently be a heat exchanger such as a shell and tube exchanger, a double pipe exchanger, etc., or heating zone 2 may comprise heating coils suspended in a waxy oil stock storage tank. Heat is transferred from the heating fluid to the waxy oil stock-solvent mixture primarily by convection. Maximum temperatures necessary for dissolving all solid wax in waxy oil stock-solvent solutions contemplated for processing according to the present invention do not exceed about 180° F. (82° C.) and commonly do not exceed about 160° F. (70° C.). Consequently, heat exchangers having high radiant heat flux, and hot tube walls, such as direct fired heaters, are not preferred for this service.

In mixing zone 6, the second portion of dewaxing solvent from nozzle 20 is mixed with flowing first oil-solvent solution by plug flow radial mixing to thoroughly mix the oil and solvent. Preferably second dewaxing solvent is injected into the oil-solvent solution via nozzle 20 as a fine spray of droplets. Such injection improves mixing of the oil and solvent. Plug flow radial mixing of oil and solvent provides through mixing of oil and solvent without use of rotating mixing equipment. Consequently construction, operating and maintenance expenses are substantially reduced over conventional dewaxing processes which employ agitators and/or wall scrapers. Plug flow radial mixing, as previously described, comprises a series of steps wherein the flowing stream to be mixed is divided, and each division is rotated upon its hydraulic axis, forcing liquid from the center of the flowing streams to the outer walls, and liquid from the outer walls to the center. The next succeeding mixing step redivides the streams from the first step into new divisions, each comprising portions of all the streams exiting the first step, and rotates the new divisions in the opposite direction about their hydraulic radius. Thus in each mixing step, each division of the liquid (in this case waxy oil stock and solvent) is mixed, and in the next succeeding step portions of each division are mixed with each other. In order to obtain the degree of mixing desired for waxy oil and solvent in the present process, from about 100,000 to about 1,000,000 divisions and redivisions of the waxy oil and solvent are required. This degree of mixing requires from about 9 to about 20 mixing elements in the plug flow radial mixer following each point of oil injection. The number of mixing elements will be determined by the degree of mixing and the type of mixer selected. Some plug flow radial mixers divide the flow into two divisions at each step, and some mixers divide the flow into four divisions at each step.

In plug flow radial mixing, a discreet amount of mixing is accomplished by each element at each step. Thus, unlike agitation, where more or less mixing at each stage can be accomplished by increasing or decreasing residence time and/or agitator speed in that stage, residence time does not contribute substantially to the degree of mixing. In plug flow radial mixng, the liquid to be mixed must pass through a certain number of stages for a certain degree of mixing. In the present invention, relatively rapid mixture of the second solvent portion into the first oil solvent solution following injection into the mixing zone is desirable. As each element of the plug flow radial mixers occupies a length equivalent to about 1.5 diameters of the mixing zone, and as mixing zones for commercial scale solvent dewaxing units may conveniently be about six inches (15.24 cm) in diameter, a minimum velocity of about 0.5 ft/sec (0.15 m/sec) for solvent and oil in the mixing zone is desirable. Stated in a more generalized way, the preferred minimum velocity of solvent and oil in the mixing zone is equivalent to about one mixing zone diameter per second.

A maximum for the flow velocity of waxy oil and solvent in the mixing zone is also desirable. This maximum is preferably equivalent to about eight mixing zone diameters per second. That is about 4 ft/sec. (0.22 m/sec) for a 6 inch (15.24 cm) diameter. Upon injection of cold second solvent portion into the warmer first oil-solvent solution, small regions of temperature discontinutes develop, which are equilibrated as the oil and solvent are thoroughly mixed. In cooler regions, wax nuclei will form, while in warmer regions wax will remain in solution. As the oil and solvent are mixed and the temperature equilibrates some of the lower melting point wax nuclei formed in the cooler regions will melt and some wax from the warmer regions will precipitate as wax nuclei crystals. This melting and precipitating of wax crystals, that is equilibrating of wax nuclei, takes a little time, and it is desirably completed within mixing zone 6. The maximum velocity equivalent to about eight mixing zone diameters gives sufficient time for the wax nuclei to equilibrate as the waxy oil-solvent temperature is equilibrated within a mixing zone 6.

Cooling of oil/solvent mixture in cooling zones 4 and 8 is contemplated to be via indirect heat exchange with a refrigerant fluid, preferably in double pipe heat exchangers. However, if desired, cooling may be by direct heat exchange, such as vaporization of a low-boiling solvent at reduced pressures. The discussion herein will be limited to indirect cooling in tubular double pipe exchangers. Such double pipe heat exchangers may be equipped with wall scrapers for removing any deposited wax from the cold exchanger walls. Preferably, however, such rotating mechanical equipment is replaced with stationary plug flow radial mixers. Plug flow radial mixing of the wax/oil/solvent mixture in cooling zones 4 and 8 reduces transverse temperature differentials across the flowing mixture to about 1° F. or less, such that super cooling of the mixture at the cold wall, and concomitant precipitation of low melting point wax, are avoided. Precipitation of low melting point wax, in a cold zone near the cold wall produces two undesirable effects. The low melting point wax, when exposed to warmer oil-solvent mixtures becomes tacky or sticky. This sticky wax then tends to stick to the wall of the exchanger, contributing to wax build-up, decreased heat exchanger rates, increased pressure drops, etc. Also, the sticky wax tends to agglomerate into irregular shaped large particles containing substantial amounts of occluded oil, thereby contributing to decreased dewaxed oil product yields. As stated above, plug flow radial mixing of the wax/oil/solvent mixture in the cooling zones eliminates cold zones at the walls of the heat exchangers, thus low melting point wax is not precipitated until the entire body of flowing mixture is cooled to the precipitation temperature. Consequently the precipitated wax is not sticky and does not tend to accumulate on the heat exchanger wall. Also, in plug flow radial mixing, flowing mixture is directed at heat exchanger walls, thus scouring any wax which may accumulate thereon. Additionally, with plug flow radial mixing in the cooling zones, wax tends to precipitate evently throughout the flowing wax-oil-solvent mixture such that mass transfer for precipitating wax from oil-solvent solution to an existing wax crystal is improved. Such improved mass transfer increases the growth rate of wax crystals and decreases the rate of wax crystal nuclei formation in the cooling zones.

For existing solvent dewaxing units employing double pipe heat exchangers, in the cooling zones, temperatures of refrigerant fluids employed may be substantially lower than temperatures of oil/solvent mixtures in order to obtain desired heat transfer rates in the cooling zones. Consequently, the heat exchanger walls may be quite cold, such that wax will tend to accumulate. When plug flow radial mixing is employed, heat transfer rates are substantially improved (up to 3–4 times the heat transfer rates for unmixed systems). Therefore, temperature differentials between refrigerant fluids and oil/solvent mixtures may be decreased while maintaining the same rate of heat transfer. With decreased temperature differentials the heat exchanger walls are relatively warmer and wax does not have such a tendency to accumulate. In some existing systems, however, increasing refrigerant temperatures may require substantial changes in refrigeration systems and may be quite costly. In such instances, economics may determine that continued use of scraped wall exchangers in less expensive than conversion to plug flow radial mixing which would also require substantial refrigeration system changes.

EXAMPLE

In order to demonstrate the process of the present invention, the following example is provided. A wax distillate oil of (SAE-20 grade), furfural refined for removal of aromatic hydrocarbons and polar organic compounds, is dewaxed according to the process of the present invention. Physical properties of the refined SAE-20 grade oil are given in Table I, below:

TABLE I

| REFINED WAX DISTILLATE SAE-20 GRADE | |
|---|---|
| Gravity, ° API | 31.0 |
| Viscosity, SUS, 100° F | 254 |
| Viscosity, SUS, 210° F | 50.8 |
| Viscosity Index | 109 |
| Pour Point, ° F | 110 |
| Refractive Index 70° C | 1.4616 |
| Wax Content, Wt. % | 12.9 |

In the present example, SAE-20 grade oil is heated to a temperature of about 130° F. (54° C.) for melting all solid wax present therein. The heated oil is then flowed, as a continuous stream through a first double pipe heat exchanger, having Kenics (TM) static mixers therein, wherein the oil is cooled at a rate of about 3.0° F./minute (1.5° C./min) to a temperature of about 120° F. (49° C.) which is about 5° F. (3° C.) above the oil's cloud point.

Upon cooling to about 120° F. (49° C.) the oil from the first double pipe heat exchanger flows into the inlet of a mixing zone. The mixing zone comprises a pipe, having an inlet and an outlet, containing Kenics (TM) static mixers. Dewaxing solvent, comprising 70% methyl ethyl ketone (MEK) and 30% toluene is injected, via a restriction orifice, at a velocity of about 150 ft/sec, into the inlet of the mixing zone. Temperature of the dewaxing solvent is about 85° F. The solvent is injected at a rate equivalent to 2.5 volumes of SAE-20 grade oil entering the mixing zone.

In the mixing zone, dewaxing solvent and SAE-20 grade oil flow at a velocity of 2 ft/sec, and are thoroughly mixed by the Kenics (TM) static mixers such that a homogeneous mixture exits the mixing zone. The homogeneous mixture has a temperature of 110° F. (43° C.) which is about 5° F. (3° C.) below the depressed cloud point, such that wax crystal nuclei are present in the oil-solvent solution.

From the exit of the mixing zone, the mixture of wax/oil/solvent flows continuously into a second cooling zone which comprises a series of double pipe heat exchangers having Kenics (TM) static mixers therein. In the second cooling zone, the wax/oil/solvent mixture is cooled at a uniform rate of 1.5° F./min (1° C./min) to a temperature of −5° F. (−20° C.). The mixture flows in the second cooling zone at a velocity of 2 ft/sec. Additional wax precipitates from the oil in the second cooling, causing the wax crystal nuclei to grow larger. Action of the Kennics (TM) static mixers maintains transverse temperature differentials at less than 1° F. (0.5° C.), and maintains the wax crystals homogeneously dispersed throughout the body of flowing fluid.

From the second cooling zone, the wax/oil/solvent mixture flows to a rotary vacuum filter operating at 400 mm Hg pressure, wherein wax crystals are filtered from the oil-solvent solution at −5° F. (−20° C.). Upon filtration, the wax filter cake is washed with an amount of −5° F. (−20° C.) dewaxing solvent equivalent to 0.65 volumes of SAE-20 charge, and the solvent washed wax cake is air dried for 60 seconds. The washed wax cake is recovered from the drum of the rotary vacuum filter. The oil/solvent filtrate from the rotary vacuum filter is fractionally distilled to yield a dewaxed oil product fraction and a solvent fraction. Operating conditions and test results on dewaxed oil and wax cake are shown in Run 1 Table II, below:

TABLE II

| RUN No. | 1 | 2 |
|---|---|---|
| Dilution Ratio (vol. solvent/vol. SAE-20 charge) | 2.5/1 | 2.5/1 |
| Solvent Temperature (° F) | 85 | — |
| Cooling Rate ° F/min. | 1.5 | 1.5 |
| Filter Temperature (° F) | −5 | −5 |
| Wash Ratio (vol. wash solvent/ vol. SAE-20 charge) | 0.65/1 | 0.65/1 |
| Dewaxed Oil Yield (vol % SAE-20 charge) | 77 | 70 |
| Dewaxed Oil Pour Point (° F) | 14 | 14 |
| Filter Capacity (Gal. dewaxed oil/ft$^2$ filter/hr) | 12.4 | 11.2 |
| Wax Cake Oil Content (% SAE-20 charge) | 21 | 33 |

For comparison, the SAE-20 grade charge is dewaxed in a scraped surface exchanger process typical of commercial operations. SAE-20 grade oil is mixed with 2.5 volumes of dewaxing solvent comprising 70% toluene, and the mixture heated above 125° for melting all the wax and forming a solution. This hot oil/solvent solution continuously flows through a series of double pipe heat exchangers fitted with scraper blades for scraping any deposited wax from the walls of the heat exchanger. Cooling of the wax/oil solution is maintained at a uniform rate of 1.5° F./min for crystallization of wax until a temperature of −5° F. is obtained. From the scraped surface heat exchangers, a mixture of wax crystals in oil/solvent solution is continuously filtered in a rotary vacuum filter operated at −5° F. and 400 mm hg. for forming a wax filter cake and a dewaxed oil/solvent filtrate. The wax filter cake is washed with −5° F. solvent in an amount equivalent to 0.65 volumes SAE-20 grade charge. After washing, the filter cake is dried by drawing air through the wax cake on the filter drum for 60 seconds. The dried wax is recovered from the drum of the rotary vacuum filter. The oil/solvent filtrate is fractionally distilled to yield a dewaxed oil product fraction and a solvent fraction. Operating conditions and test results on dewaxed oil and wax cake are shown as Run 2 in Table II, above.

Comparing results from Runs 1 & 2 of Table II, it is seen that the process of the present invention, compared to results from a solvent dewaxing process using scraped surface exchangers yields increased dewaxed oil (77% vs. 70%) at the same pour point, and produces a wax cake with less entrained oil (21% vs 33%). Additionally, the process of the present invention does not use rotating equipment such as scrapers or agitators which require substantial investment and operating expense.

We claim, and wish to protect by Letters Patent:

1. In a continuous solvent dewaxing process wherein an intermediate waxy petroleum distillate oil charge stock is diluted with dewaxing solvent to depress its cloud point and to form an oil/solvent mixture having all wax dissolved therein, wherein the oil-solvent mixture is cooled, in a cooling zone, to a selected separation temperature for precipitating wax crystals and forming a wax/oil/solvent mixture, wherein the precipitated wax is separated from said wax/oil/solvent mixture in a solid-liquid separation zone, forming a solid wax cake and a wax-free oil/solvent mixture, and wherein the wax-free oil/solvent mixture is fractionated, in a fractionation zone to yield a solvent fraction and a dewaxed oil product fraction; the improvement comprising:

(a) cooling, in a first cooling zone, an intermediate waxy petroleum distillate oil stock, having all wax dissolved therein, to a temperature about 5° F. above the cloud point;

(b) mixing, in a mixing zone, under conditions of plug flow radial mixing the waxy oil stock at a temperature about 5° F. above the cloud point with dewaxing solvent at a temperature between about 70° to 100° F. and about 25° to 40° F. below the depressed cloud point in a volume ratio of solvent to waxy oil stock in the range of from about 1:1 to about 5:1 for forming a waxy oil stock/solvent mixture having a temperature about 5°–15° F. below its depressed cloud point such that wax is precipitated therefrom;

(c) cooling, in a second cooling zone, said cooled mixture from step (b) at a uniform cooling rate in the range of from about 1°–8° F./min to a selected temperature in the range of about 0° to 40° F. for precipitating additional wax; and (d) flowing the cooled mixture from step (c) to said solid-liquid separation zone.

2. The method of claim 1 wherein the waxy petroleum oil stock in step (a) is prediluted with dewaxing solvent in a solvent/oil volume ratio in the range of about 0:1 to 2:1 for maintaining fluidity of waxy oil stock in said first cooling zone; and wherein waxy oil stock is diluted with dewaxing solvent in said mixing zone in a solvent/waxy oil stock volume ratio of about 1:1 to about 3:1.

3. The method of claim 2 wherein dewaxing solvent is injected into said waxy oil stock flowing in said mixing zone as a spray of fine liquid droplets.

4. The method of claim 3 wherein waxy oil stock in said first cooling zone is cooled under conditions of plug flow radial mixing.

5. The method of claim 4 wherein the waxy oil stock is cooled in said first cooling zone via indirect heat exchange.

6. The method of claim 4 wherein the waxy oil stock is cooled in said first cooling zone via direct heat exchange with a vaporizing low boiling liquid under conditions of reduced pressure.

7. The method of claim 5 wherein the waxy oil stock-solvent mixture in said second cooling zone is cooled under conditions of plug flow radial mixing via indirect heat exchange.

8. The method of claim 6 wherein the waxy oil stock-solvent mixture in said second cooling zone is cooled under conditions of plug flow radial mixing via direct heat exchange with a vaporizing low boiling liquid under conditions of reduced pressure.

* * * * *